US010471463B2

(12) United States Patent
Thalacker

(10) Patent No.: US 10,471,463 B2
(45) Date of Patent: Nov. 12, 2019

(54) MULTIPURPOSE FRAME SYSTEM

(71) Applicant: Teresa E Thalacker, Mesa, AZ (US)

(72) Inventor: Teresa E Thalacker, Mesa, AZ (US)

( * ) Notice: Subject to any disclaimer, the term of this patent is extended or adjusted under 35 U.S.C. 154(b) by 289 days.

(21) Appl. No.: 15/644,824

(22) Filed: Jul. 10, 2017

(65) Prior Publication Data

US 2019/0009299 A1 Jan. 10, 2019

(51) Int. Cl.
*B05C 17/02* (2006.01)
*B25G 1/04* (2006.01)
*B25F 3/00* (2006.01)

(52) U.S. Cl.
CPC ..... *B05C 17/0217* (2013.01); *B05C 17/024* (2013.01); *B05C 17/0205* (2013.01); *B25F 3/00* (2013.01); *B25G 1/04* (2013.01)

(58) Field of Classification Search
CPC ..... B05C 17/0205; B05C 17/0217; B05C 17/024; B25G 1/04
See application file for complete search history.

(56) References Cited

U.S. PATENT DOCUMENTS 2,811,733 A * 11/1957 Sloan ..... A47L 11/085 15/154
3,386,124 A * 6/1968 Wolfgang ..... B05C 17/0217 15/143.1
3,877,823 A * 4/1975 Leland ..... B05C 17/0217 401/197
4,337,002 A * 6/1982 Martucci ..... B05C 17/02 15/230.11
2007/0067936 A1* 3/2007 Hodges ..... B05C 17/0217 15/230.11

* cited by examiner

*Primary Examiner* — Randall E Chin
(74) *Attorney, Agent, or Firm* — Kevin H Day

(57) ABSTRACT

A multipurpose frame system providing a Y-shaped frame with angular bend attached to a U-shaped frame capable of receiving and securing a functional system, such as, for example in one embodiment, a cylindrical roller for receiving and securing a paint roller pad, and functional system separately capable of being fully disconnected.

20 Claims, 5 Drawing Sheets

MULTIPURPOSE FRAME SYSTEM

BACKGROUND

I. Field of the Invention

The field of invention relates to multipurpose frames with at least one use including receiving paint rollers for application of paint.

II. Description of the Related Art

There is a need for a system to be easy, ergonomic, versatile, cost-effective, and time-efficient for application of paint to various surfaces. Additionally, there is a need for the same system to be just as effective and efficient at clean-up and environmentally-friendly through paint roller preservation.

BRIEF SUMMARY

A multipurpose frame system providing a Y-shaped frame with angular bend attached to a U-shaped frame capable of receiving and securing a functional system, such as, for example in one embodiment, a cylindrical roller for receiving and securing a paint roller pad, and functional system separately capable of being fully disconnected.

DETAILED DESCRIPTION OF THE DRAWING

The multipurpose frame system will be explained with reference to the accompanying drawings in detail.

Figure 1:
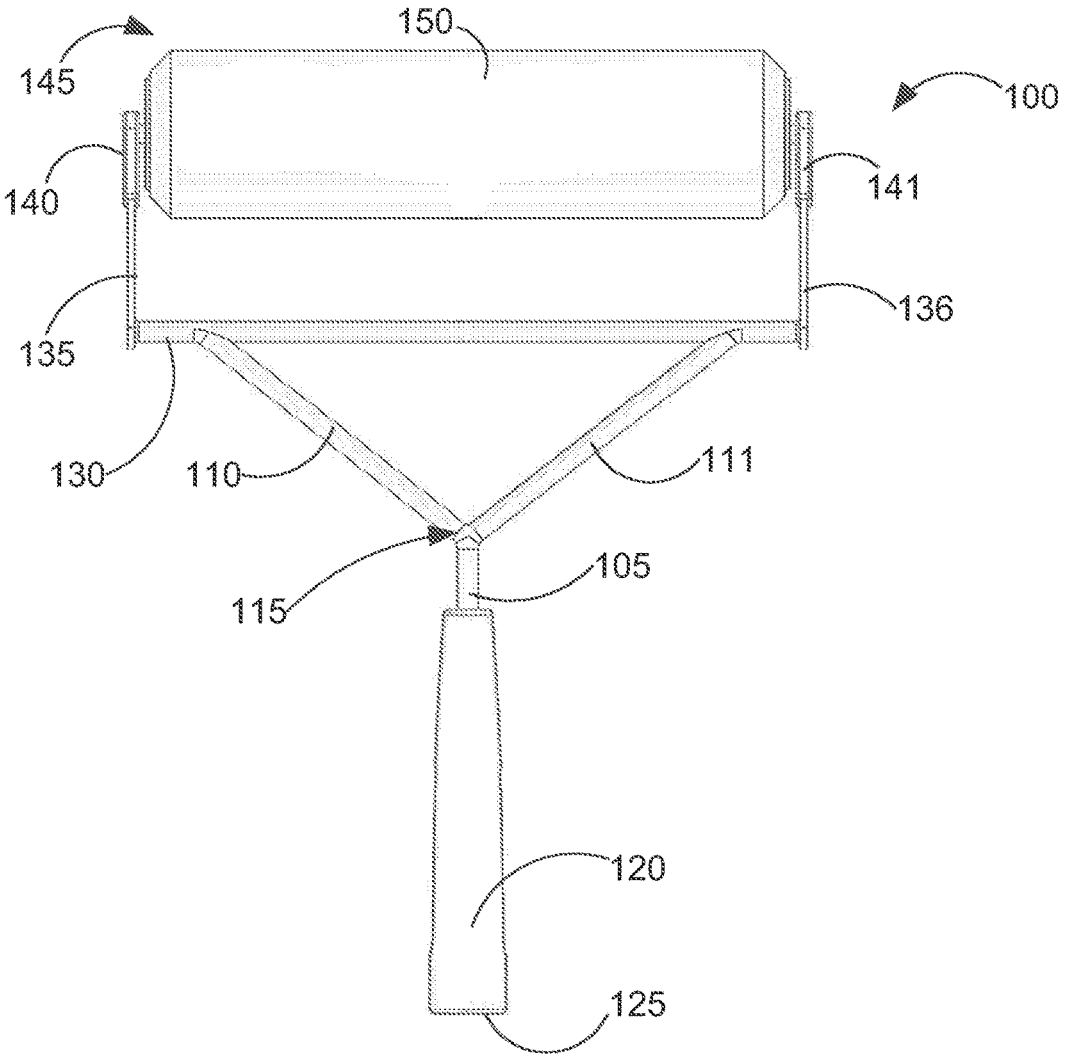
FIG. 1 shows a top perspective view illustrating a multipurpose frame system according to an embodiment of the present invention.
Figure 2:
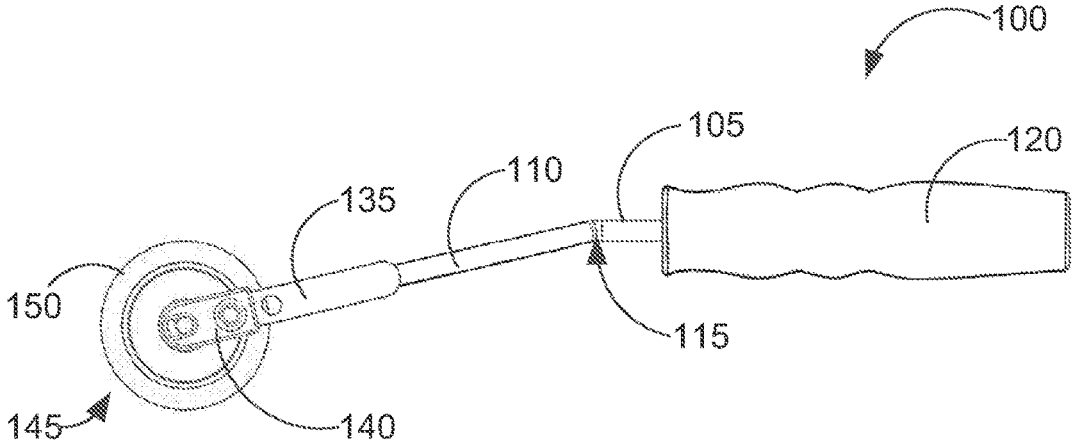
FIG. 2 shows a side perspective view illustrating an angular bend of multipurpose frame system according to an embodiment of the present invention.
Figure 3:
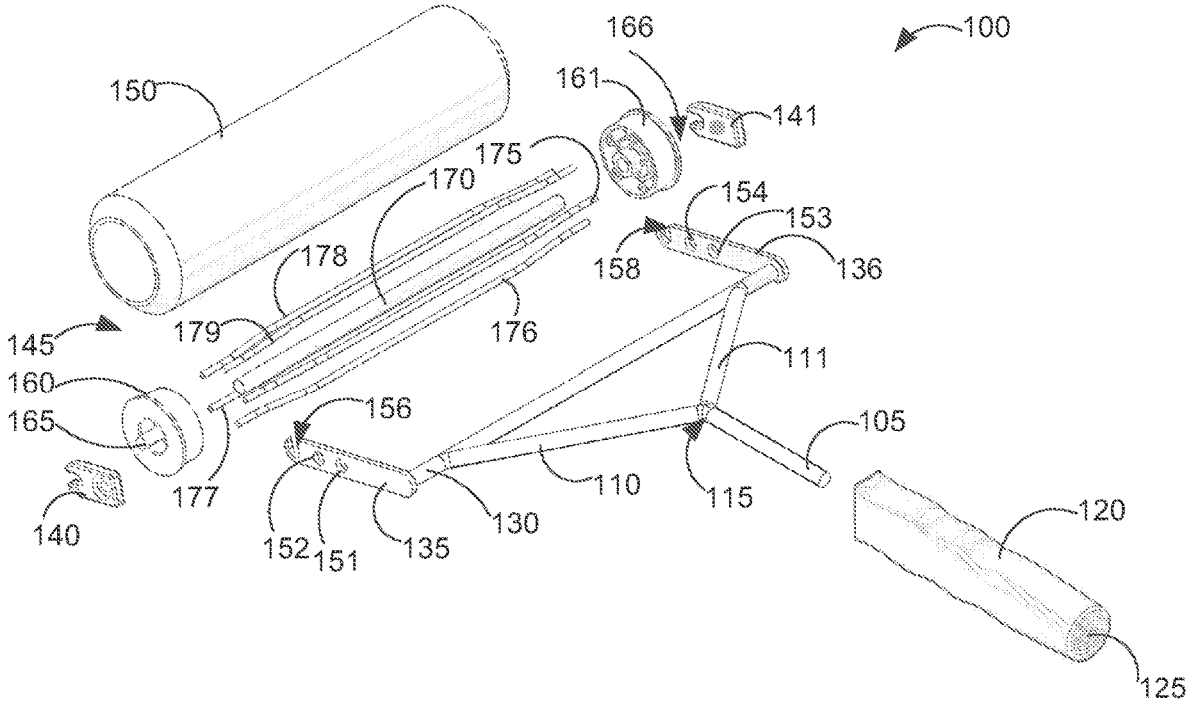
FIG. 3 shows an exploded view illustrating a multipurpose frame system according to an embodiment of the present invention.
Figure 4:
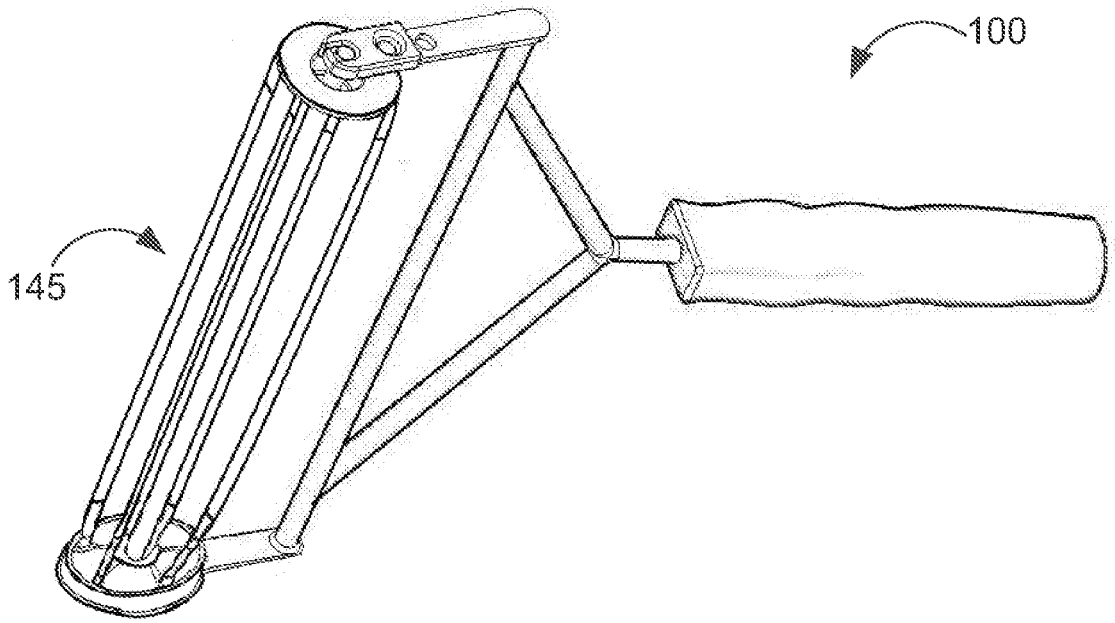
FIG. 4 shows a side-angle perspective illustrating a multipurpose frame system according to an embodiment of the present invention.

FIG. 1 shows a top perspective view illustrating a multipurpose frame system according to an embodiment of the present invention. FIG. 2 shows a side perspective view illustrating an angular bend of multipurpose frame system according to an embodiment of the present invention. FIG. 3 shows an exploded view illustrating a multipurpose frame system according to an embodiment of the present invention. FIG. 4 shows a side-angle perspective illustrating a multipurpose frame system according to an embodiment of the present invention.

As shown in FIGS. 1-4, multipurpose frame system 100 may be used as utility tool for painting. Multipurpose frame system 100 may include vertical arm 105 and angled support arms 110, 111 which form the shape of a Y, as best shown in FIGS. 1 and 3. Vertical arms may include multiple vertical arms and angled support arms may include multiple angled support arms. Vertical or angled support arms may be made of metal including but not limited to, for example, steel. Alternately, vertical arms or angled support arms may be made up of, such as, for example, plastic, polymers, composites, alloys, combination thereof, or alternative rigid material. Vertical arm 105 may include handle 120, as shown in FIGS. 1-3. Handle 120 may include handle end 125 capable of receiving and securing an extension adapter, such as, for example, rod, pole, or similar means for adding length to multipurpose frame system 100. Handle end 125 may be a female threaded end for receiving a threaded male end of an extension pole. Alternately, handle end 125 may be solid. Handle 120 may be ergonomic in design for user comfort. Alternately, handle 120 may be smooth, rubber-coated, stippled, ridged, or combination thereof for purpose of design preferences or better grip traction. Handle 120 may also include ornamental design elements for customization or marketing. Upon reading the teachings of this specification, those with ordinary skill in the art will now realize that, according to such issues as user preferences, economic considerations, and environmental considerations, handles may vary.

The Y-shaped form of vertical arm 105 and angled support arms 110, 111 provides for even force dispersion across functional system 145 from user applied force to handle 120. Additionally, as shown in FIGS. 1-3, junction 115 is the intersection of vertical arm 105 and angled support arms 110, 111. Vertical arm 105 and angled support arms 110, 111 may be joined through welding, as shown. Alternately, and depending upon user preferences, economic considerations, die cast technology, metal bonding technologies, polymer bonding technologies, etc., vertical arm 105 and angled support arms 110, 111 may be die cast as a solid piece, bonded, or combination thereof to form junction 115. Junction 115 may include an angular bend between vertical arm 105 and two angled support arms 110, 111 which may range between three degrees and thirty degrees depending upon specific uses or needs. For example, junction 115, as shown in FIG. 2, has an approximately five degree bend. These acute angular bends are optimal for paint or similar coating application. The angular bend in junction 115 provides for better contact of functional system 145, and more specifically, accessory to functional system 145, paint roller pad 150, as shown in FIGS. 1-3, to a surface, such as, for example, a wall, ceiling, door, furniture, or any other surface to receive paint or similar chemical compound for protection, coating, or decoration. The Y-shaped frame and angular bend allows a user to apply less force and strain to handle 120 while allowing for greater, more even coverage from functional system 145, including paint roller pad 150, as compared to prior art. Referencing FIGS. 1 and 2, the angular bend may be at junction 115, as shown, or alternately, may occur, such as, for example, in vertical arm 105, angular support arms 110, 111, at the junction between angular support arms 110, 111 and base arm 130, at the junction of base arm 130 and perpendicular arms 135, 136, or the like. Multipurpose frame systems may have multiple angular bends. Upon reading the teachings of this specification, those with ordinary skill in the art will now realize that, according to such issues as user preferences, economic considerations, application considerations, surface considerations, advances in physics, etc., angular bends may vary in number of bends, degrees, and locations on multipurpose frame systems. Upon reading the teachings of this specification, those with ordinary skill in the art will now realize that, according to such issues as user preferences, economic considerations, advances in frame technology, advances in bonding technology, etc., Y-shaped frames may vary in size, material, and connection means.

Multipurpose frame system 100 may include base arm 130 and perpendicular arms 135, 136, which form the shape of a U, as best shown in FIGS. 1 and 3. Base arms may include multiple base arms and perpendicular arms may include multiple perpendicular arms. Base arms or perpendicular arms may be made of metal including but not limited to, for example, steel. Alternately, base arms or perpendicular arms may be made up of, such as, for example, plastics, polymers, composites, alloys, combination thereof, or alternative rigid material. Base arm 130 may intersect and attach to angled support arms 110, 111, as shown in FIGS. 1 and 3.

The U-shape form of base arm 130 and perpendicular arms 135, 136 provides a mechanism for supporting, holding, or otherwise controlling functional system 145, as best shown in FIGS. 1, 4, 6, and 7. Perpendicular arms 135, 136 may include apertures 151, 152, 153, 154 and cavities 156, 158 for supporting, holding, or otherwise controlling functional system 145, as shown best in FIGS. 1, 3, 6, and 7. Perpendicular arms 135, 136 may include two apertures each, as shown, or alternately may include one aperture each or more than two apertures each. Perpendicular arms 135, 136 may include one cavity each, as shown, or alternately may include more than one cavity each. Upon reading the teachings of this specification, those with ordinary skill in the art will now realize that, according to such issues as user preferences, economic considerations, advances in frame technology, advances in bonding technology, etc., U-shaped frames may vary in size, material, and connection means.

Figure 5:
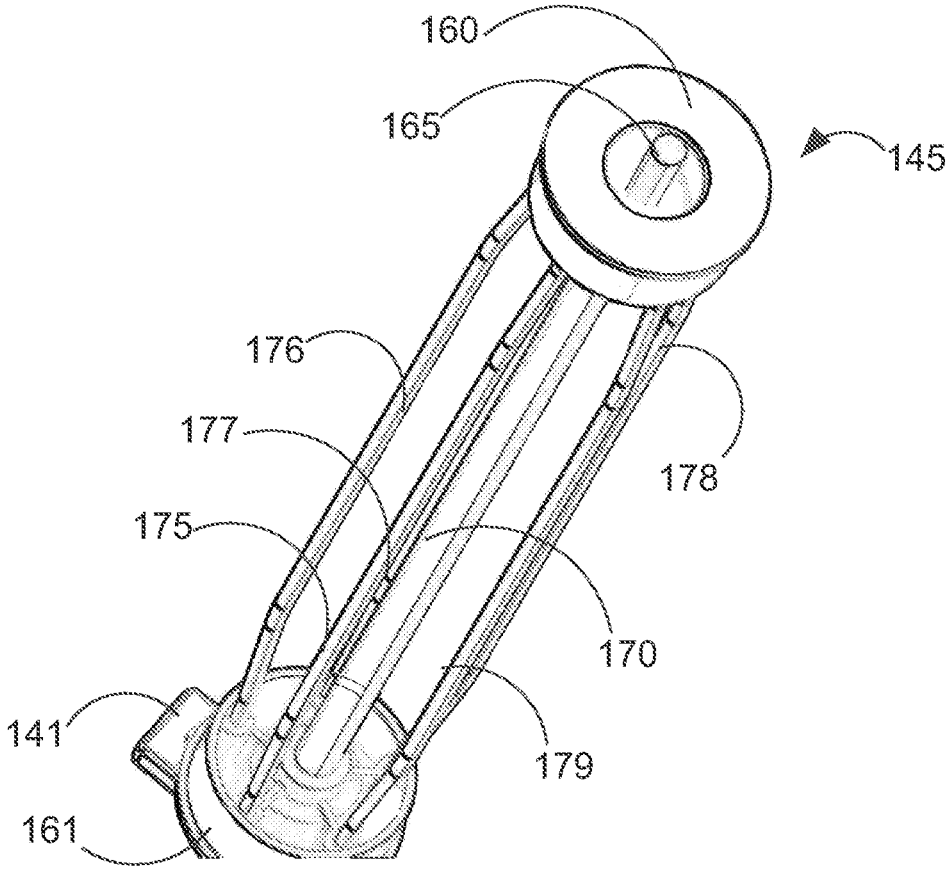
FIG. 5 shows a top-angled perspective view illustrating a functional system according to an embodiment of the present invention.
Figure 6:
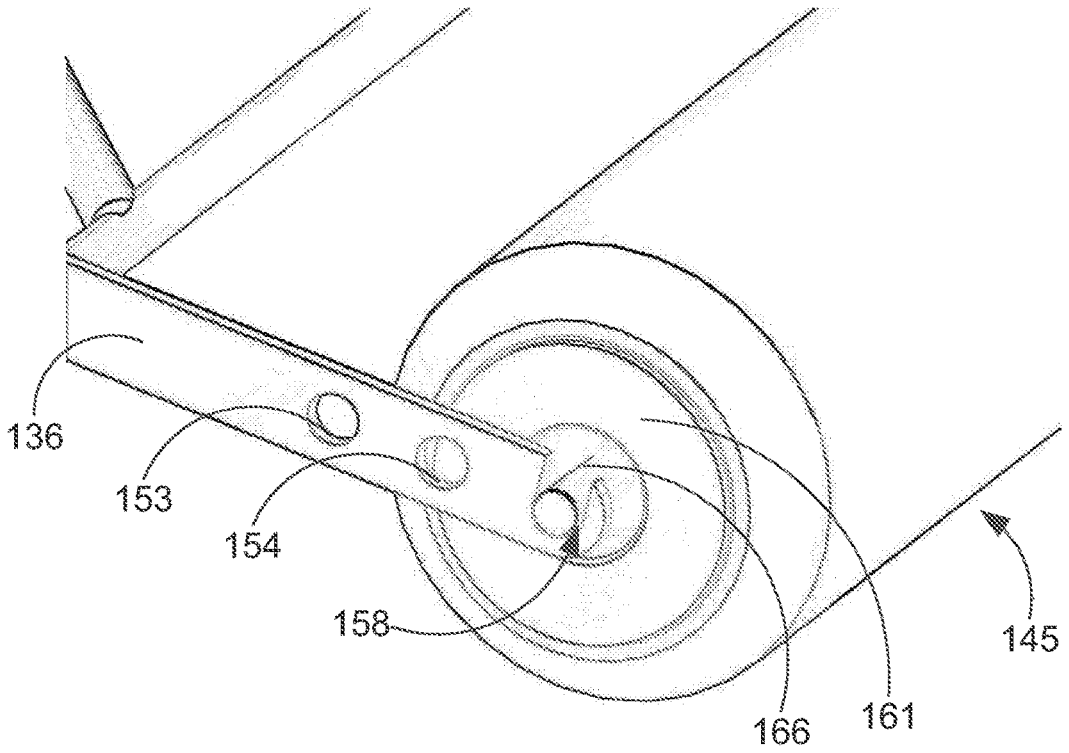
FIG. 6 shows a close-up side perspective view illustrating a multipurpose frame system without functional system fastener according to an embodiment of the present invention.
Figure 7:
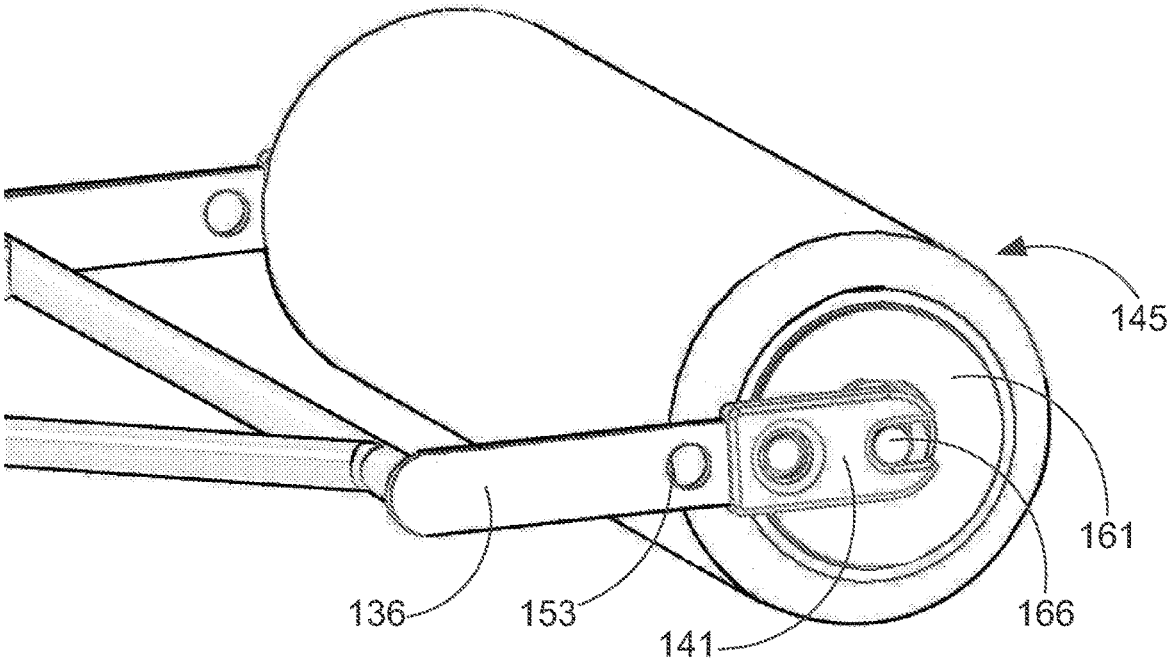
FIG. 7 shows a close-up side perspective view illustrating a multipurpose frame system with functional system fastener according to an embodiment of the present invention.

FIG. 6 shows a close-up side perspective view illustrating a multipurpose frame system without functional system fastener according to an embodiment of the present invention. FIG. 7 shows a close-up side perspective view illustrating a multipurpose frame system with functional system fastener according to an embodiment of the present invention. Any discussion with reference to FIGS. 6 and 7 showing a close-up of one side, note, there is a corresponding second side as illustrated in FIGS. 1-4 which may be defined and described in similar manner and therefore, applicable figure numbers are incorporated by reference for purpose of complete disclosure. As shown in FIGS. 1-4 and 6, functional system 145 may be fastened to multipurpose frame system 100 through use of clips 140, 141. Clips 140, 141 may slide over perpendicular arms 135, 136, respectively, to secure cavities 156, 158, respectively, as best shown on one side by FIG. 6. Clips 140, 141 may use apertures 152, 154, respectively, to lock in place, as shown through combination of FIGS. 1-4 and 7. Alternately, clips 140, 141 may use apertures 151, 153, respectively, to remain attached to perpendicular arms 135, 136, respectively, preventing loss while un-securing cavities 156, 158, respectively, to remove functional system 145 as shown through a combination of FIGS. 4-7. Clips 140, 141 may be made of plastic. Alternately, clips 140, 141 may be made of polymers, metal, alloy, composites, combination thereof, or other alternative rigid material. Alternately, perpendicular arms 135, 136 may include other fastener systems, such as, for example, snap hook, screw, or similar fastener system which allows for disconnect between functional system 145 and at least one of perpendicular arm 135 or perpendicular arm 136. Upon reading the teachings of this specification, those with ordinary skill in the art will now realize that, according to such issues as user preferences, economic considerations, advances in fasteners, etc., fasteners may vary to secure functional systems to multipurpose frame systems.

Functional system 145 has protrusions 165, 166 which may be received by cavities 156, 158, respectively, as shown best in FIG. 6. Put another way, functional system 145 may be secured to multipurpose frame systems through insertion of protrusions 165, 166 into cavities 156, 158, respectively, and securing with clips 140, 141, respectively.

Figure 8:
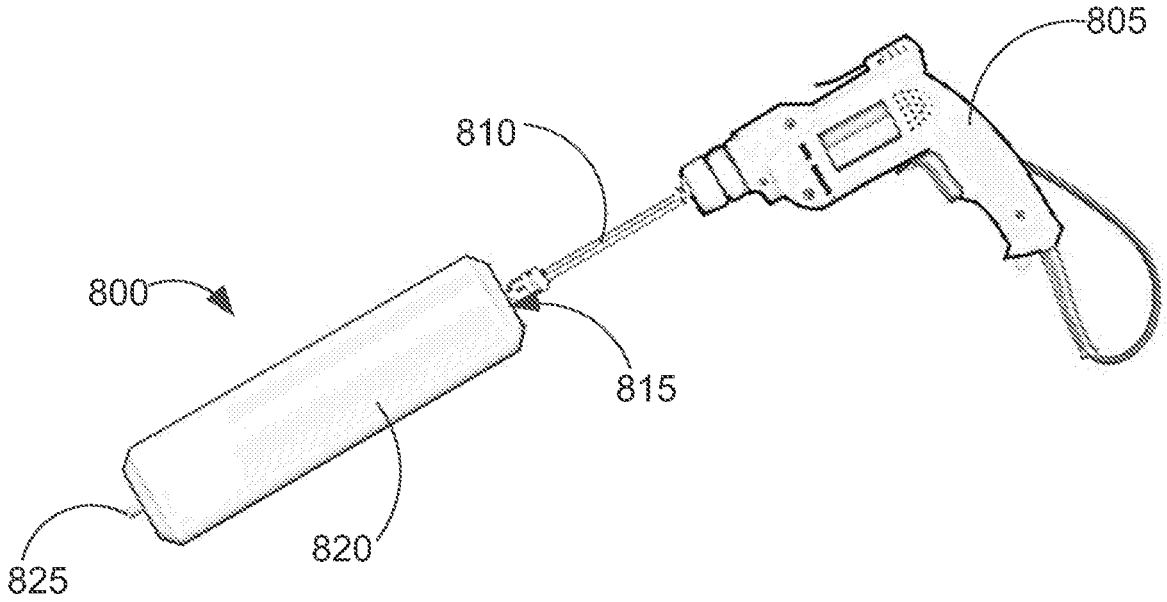
FIG. 8 shows a side perspective view illustrating cleaning of a functional system according to an embodiment of the present invention.

FIG. 5 shows a top-angled perspective view illustrating a functional system according to an embodiment of the present invention. As shown in FIG. 5, functional system 145 may be a cylindrical roller system for receiving and securing at least one paint roller pad. In this embodiment, functional system 145 may include axle 170 and support rods 175, 176, 177, 178, 179 secured between end caps 160, 161, as shown in FIG. 5 End caps 160, 161 may include protrusions 165, 166 for securing to perpendicular arms 135, 136. Alternately, end caps may include pass-through for axle, whereby axle serves as protruding element for securing to perpendicular arms. End caps 160, 161 may be made of plastic, metal, alloy, composite, combination thereof, or alternative rigid material. Axle 170 and support rods 175, 176, 177, 178, 179 may be made of metal, such as steel, as shown. Alternately, axle 170 and support rods may be made of plastic, alloy, composite, combination thereof, or other alternative rigid material. Functional system 145 may be fully detached from multipurpose frame system 100, as shown in FIGS. 5 and 8. Functional systems may detach for purposes of cleaning, storing, space-saving, or changing out functional systems entirely with other embodiments.

Functional system 145, as shown in FIGS. 1-9, is one embodiment of functional systems. Alternately, functional systems may include other embodiments, such as, for example, a flat, smooth rubber blade used to remove or control the flow of liquid on a flat surface; a stiff-bladed flat, smooth rubber blade used to remove or control the flow of grout, cement, paste, or other types of mortar; a roller of one-side adhesive paper on a central spindle to facilitate removal of lint or other small fibers from clothing, upholstery, or linen; a microfiber cloth to absorb liquid, dust, dirt, grime, etc.; a microfiber, woven, or knitted material to use for polishing; soft or hard bristled brushes used for many applications; or a broad flat or scooped blade used to move loose matter, such as soil, dirt, rocks, snow, to name a few among many different types of loose matter. Upon reading the teachings of this specification, those with ordinary skill in the art will now realize that, according to such issues as user preferences, economic considerations, marketing considerations, etc., multipurpose frame systems may vary widely through interchanging functional systems.

One embodiment of multipurpose frame system 100 without any accessories, such as, for example, paint roller pads, is shown in FIG. 4. As discussed, this embodiment relates to a multipurpose frame system for painting or application of liquid compound, acrylic, or similar coating for purposes of protecting, coating, decorating, or the like. Alternately, multipurpose frame systems may utilize varying functional systems, such as, for example, squeegee systems, including cleaning, construction, flooring, tiling, and other similar uses for a blade system to remove or control flow; brush systems, including cloth, soft or hard bristled brushes, for liquid absorption, polishing, or dirt, dust, lint, and grime removal; or shoveling systems, including broad flat or scooped blade used to move soil, dirt, rocks, snow, and other different types of loose matter.

FIG. 8 shows a side perspective view illustrating cleaning of a functional system according to an embodiment of the present invention. As shown in FIG. 8, functional system 800 may be completely disconnected from a multipurpose frame system. Overall removal from a multipurpose frame system allows for functional system 800 to be easily cleaned. Functional system 800, as shown in FIG. 8, may be a paint roller system holding paint roller pad 820. Functional system 800 includes protrusion 815, not visible in FIG. 8 as it is being held by drill bit extension adapter 810. Functional system 800 further includes protrusion 825. Either protrusion 815 or protrusion 825 may be used to hold functional system 800. Drill bit extension adapter 810 may be used by drill 805 to grasp functional system 800, as shown. Alternately, functional system 800 may be held directly by drill 805 without use of drill bit extension adapter 810. Operation of drill 805 generates sufficient forces upon functional system 800 holding paint roller pad 820 to easily clean, discharge paint residue, and dry paint roller pad 820. Application of water to paint roller pad 820 prior to operating drill 805 will only further enhance the cleaning process. Complete removal of functional system 800 from a multipurpose frame system may allow for easy removal of paint roller pad 820 in lieu of any cleaning process for reuse or disposal of paint roller pad 820. Upon reading the teachings of this specification, those with ordinary skill in the art will now realize that, according to such issues as user preferences, economic considerations, environmental considerations, cleaning methods may vary and removal of functional system greatly assists in any of these methods.

Figure 9:
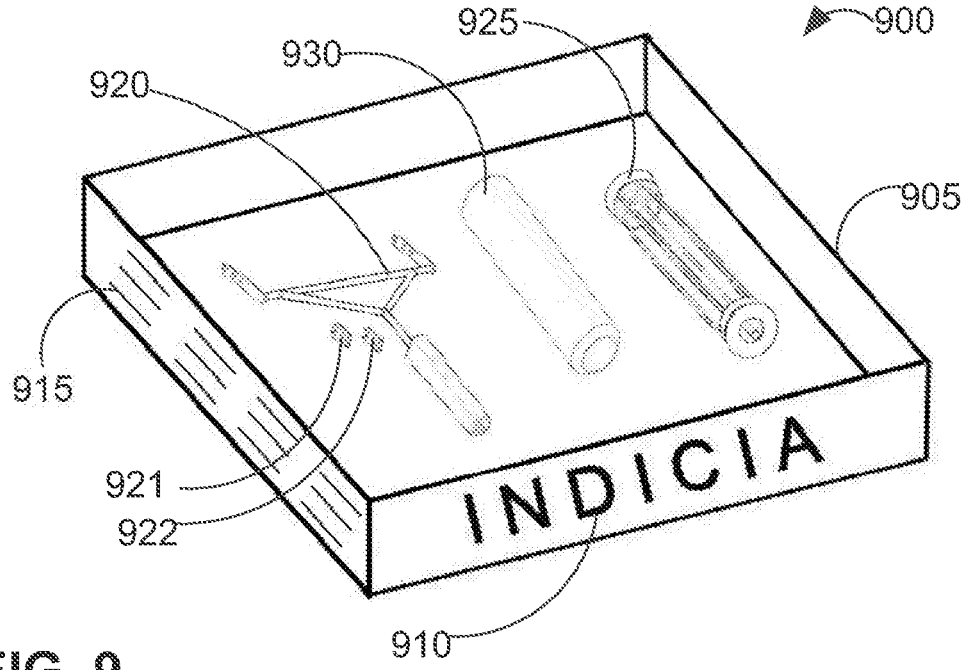
FIG. 9 shows a schematic drawing illustrating one embodiment of a kit of the present invention.

FIG. 9 shows a schematic drawing illustrating one embodiment of a kit of the present invention. As shown in FIG. 9, a multipurpose frame system may be sold as a packaged collection or kit. Kit 900 includes container 905 for holding the contents of the kit. Container 905 may be a box, as shown, or other type of packaging capable of holding the contents of kit 900. Container 905 may be labeled using indicia 910, as shown. Indicia 910 may be a logo, brand, title, or some other type of identifying mark or language to identify multipurpose frame systems. Container 905 may contain multipurpose frame system 920. Multipurpose frame system 920 may include fasteners 921, 922 and functional system 925, as shown. Functional system 925 may be any embodiment of functional system and not limited to the embodiment shown in FIG. 9. Multipurpose frame system 920 may be any embodiment of multipurpose frame system and not limited to the embodiment shown in FIG. 9. Container 905 may include more than one multipurpose frame systems. Container 905 may include paint roller pad 930. Container 905 may include additional accessories for multipurpose frame systems, such as, for example, paint brushes, paint, drill bit extension adapter, or drill. Additionally, container 905 may include set of instructions 915. Set of instructions 915 may inform users on directives as to the proper uses or disuses of the multipurpose frame system. Set of instructions 915 may be printed on the outside of container 905, as shown. Alternately, set of instructions 915 may be printed on paper and inserted into container 905.

The functional systems as shown in FIGS. 1-9, illustrate an embodiment for cylindrical paint roller systems. Functional systems may be attached to multipurpose frame system through use of an axle, end caps with protrusions, or similar fastening mechanisms already set forth previously in this disclosure. With use of these strategic attachment mechanisms, functional systems may include other embodiments, such as, for example, a flat, smooth rubber blade used to remove or control the flow of liquid on a flat surface; a stiff-bladed flat, smooth rubber blade used to remove or control the flow of grout, cement, paste, or other types of mortar; a roller of one-side adhesive paper on a central spindle to facilitate removal of lint or other small fibers from clothing, upholstery, or linen; a microfiber cloth to absorb liquid, dust, dirt, grime, etc.; a microfiber, woven, or knitted material to use for polishing; soft or hard bristled brushes used for many applications; or a broad flat or scooped blade used to move loose matter, such as soil, dirt, rocks, snow, to name a few among many different types of loose matter.

Upon reading the teachings of this specification, those with ordinary skill in the art will now realize that, according to such issues as user preferences, economic considerations, advances in technology, etc., a multipurpose frame system may be scalable in size or application.

It is to be understood that the above described embodiments are merely illustrative of numerous and varied other embodiments which may constitute applications of the principles of the invention. Upon reading the teachings of this specification, those with ordinary sill in the art may devise other such embodiments without departing from the scope or spirit of this invention and it is our intent they be deemed within the scope of our invention.

What is claimed is:

1. A multipurpose frame system comprising:

a. a Y-shaped frame having
   i. at least one vertical arm, and
   ii. at least two angled support arms,
   iii. wherein the at least one vertical arm comprises a handle,
   iv. wherein there is an angular bend at the junction between the at least one vertical arm and at least two angled support arms, and b. a U-shaped frame having
   i. at least one base arm, and
   ii. at least two perpendicular arms with at least one at each end of the base arm forming the U shape,
   iii. wherein the at least one base arm is attached to the at least two angled support arms of the Y-shaped frame, and c. a functional system having
   i. at least one protrusion capable of being secured between the at least two perpendicular arms of the U-shaped frame,
   ii. wherein each of the at least two perpendicular arms comprises at least one cavity for receiving at least one protrusion,
   iii. wherein each of the at least two perpendicular arms comprises at least one aperture for receiving at least one fastener,
   iv. wherein at least one fastener secures at least one protrusion within the at least one cavity, and
   v. wherein the functional system may be fully disconnected from the U-shaped frame.

2. The claim according to claim 1, wherein the functional system comprises a cylindrical roller system capable of supporting and securing at least one paint roller.

3. The claim according to claim 1, wherein the handle comprises a receiving end for attachment of an extension pole.

4. The claim according to claim 1, wherein the handle comprises an ergonomic design.

5. The claim according to claim 1, wherein the Y-shaped frame comprises metal.

6. The claim according to claim 1, wherein the U-shaped frame comprises metal.

7. The claim according to claim 1, wherein the angular bend of the Y-shaped frame is between a range of three degrees to thirty degrees.

8. The claim according to claim 1, wherein the at least one protrusion is hollow for use with drill-bit extension rod for cleaning the functional system with a drill.

9. A multipurpose frame system comprising:

a. a Y-shaped frame having
   i. at least one vertical arm, and
   ii. at least two angled support arms,
   iii. wherein the at least one vertical arm comprises a handle,
   iv. wherein there is an angular bend at the junction between the at least one vertical arm and at least two angled support arms, and b. a U-shaped frame having
   i. at least one base arm, and
   ii. at least two perpendicular arms with at least one at each end of the base arm forming the U shape,
   iii. wherein the at least one base arm is attached to the at least two angled support arms of the Y-shaped frame, and c. a functional system having
   i. at least one protrusion capable of being secured between the at least two perpendicular arms of the U-shaped frame,
   ii. wherein each of the at least two perpendicular arms comprises at least one cavity for receiving at least one protrusion,
   iii. wherein each of the at least two perpendicular arms comprises at least one aperture for receiving at least one fastener,
   iv. wherein at least one fastener secures at least one protrusion within the at least one cavity,
   v. wherein the functional system may be fully disconnected from the U-shaped frame, and
   vi. wherein the functional system comprises a cylindrical roller system capable of supporting and securing at least one paint roller.

10. The claim according to claim 9, wherein the cylindrical roller system comprises a. at least one axle,
b. at least three support rods,
c. at least two end caps, and
d. wherein at least two end caps are capable of supporting at least one axle and at least three support rods.

11. The claim according to claim 9, wherein the handle comprises a receiving end for attachment of an extension pole.

12. The claim according to claim 9, wherein the handle comprises an ergonomic design.

13. The claim according to claim 9, wherein the Y-shaped frame comprises metal.

14. The claim according to claim 9, wherein the U-shaped frame comprises metal.

15. The claim according to claim 9, wherein the angular bend of the Y-shaped frame is between a range of three degrees to thirty degrees.

16. The claim according to claim 9, wherein the at least one protrusion is hollow for use with drill-bit extension rod for cleaning the functional system with a drill.

17. A kit comprising a mated system of:

a. at least one multipurpose frame system comprising:
   i. a Y-shaped frame having
      1. at least one vertical arm, and
      2. at least two angled support arms,
      3. wherein the at least one vertical arm comprises a handle,
      4. wherein there is an angular bend at the junction between the at least one vertical arm and at least two angled support arms, and
   ii. a U-shaped frame having
      1. at least one base arm, and
      2. at least two perpendicular arms with at least one at each end of the base arm forming the U shape,
      3. wherein the at least one base arm is attached to the at least two angled support arms of the Y-shaped frame, and
   iii. a functional system having
      1. at least one protrusion capable of being secured between the at least two perpendicular arms of the U-shaped frame,
      2. wherein each of the at least two perpendicular arms comprises at least one cavity for receiving at least one protrusion,
      3. wherein each of the at least two perpendicular arms comprises at least one aperture for receiving at least one fastener,
      4. wherein at least one fastener secures at least one protrusion within the at least one cavity, and
      5. wherein the functional system may be fully disconnected from the U-shaped frame, and b. at least one functional system comprising
   i. a cylindrical roller system capable of supporting and securing at least one paint roller, and c. at least one paint roller pad.

18. The claim according to claim 17 further comprising at least one paint brush.

19. The claim according to claim 17 further comprising at least one drill bit extension adapter.

20. The claim according to claim 17 further comprising at least one alternate functional system.

* * * * *